United States Patent [19]

Shibata et al.

[11] Patent Number: 4,874,927

[45] Date of Patent: Oct. 17, 1989

[54] HEATING ROLL FOR FIXING TONER

[75] Inventors: Ryoichi Shibata; Toshiyuki Kasakoshi, both of Saitama, Japan

[73] Assignee: Hitachi Metals, Ltd., Tokyo, Japan

[21] Appl. No.: 203,121

[22] Filed: Jun. 7, 1988

[30] Foreign Application Priority Data

Jun. 9, 1987 [JP] Japan ..... 62-143560

[51] Int. Cl.[4] ..... G03G 15/20

[52] U.S. Cl. ..... 219/469; 219/216; 355/286

[58] Field of Search ..... 219/469, 470, 471, 216; 355/3 FU

[56] References Cited

U.S. PATENT DOCUMENTS 4,714,819 12/1987 Yamashita ..... 219/216

4,724,305 2/1988 Iimura ..... 219/216

FOREIGN PATENT DOCUMENTS 60-3683 1/1985 Japan ..... 355/3 FU 61-134776 6/1986 Japan .

*Primary Examiner*—Teresa J. Walberg

*Attorney, Agent, or Firm*—Finnegan, Henderson, Farabow, Garrett & Dunner

[57] ABSTRACT

The resistive layer of an electrically heated toner fixing roll includes a Fe-Cr-Al metal alloy phase and a ceramic substrate phase thermally sprayed onto the surface of a thermally and electrically insulated metal roll. The ceramic substrate can be $Al_2O_3$ and the alloy can be 64–89 wt % Fe; 10–30 wt % Cr; and 2–10 wt % Al. $Al_2O_3$ can be the insulating layer, and the metal roll can be iron, or an iron-based alloy.

3 Claims, 1 Drawing Sheet

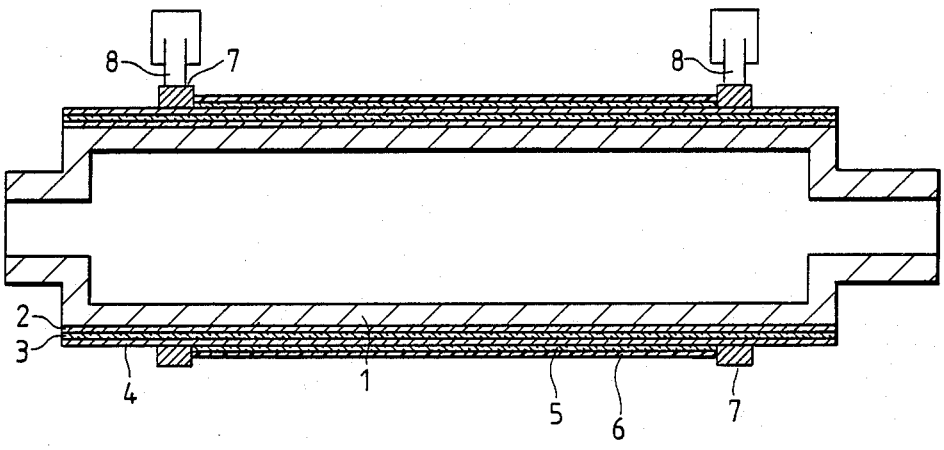
8
7
8
2
3
4
1
5
6
7

HEATING ROLL FOR FIXING TONER

BACKGROUND

1. Field of the Invention

The present invention relates to a heating roll for a toner fixing apparatus, for heating and fixing a toner-image onto paper in a copying machine, a printer, a facsimile machine, and so on, and particularly relates to an improvement in a heating resistor layer used for heating the heating roll.

2. Description of the Prior Art

Apparatus for fixing a toner-image onto paper in a copying machine, a printer or the like is known. Such apparatus can include a thermal fixing system in which resin in the toner is heated and melted to be thereby fixed or a pressure fixing system in which toner is pressed to be thereby fixed. Of the two, the thermal fixing system is widely used today since its stable fixing-ability can be maintained over a wide speed range from low to high, its thermal efficiency is high, and its safety is superior.

In a conventional heating roll used for the thermal fixing system, a halogen lamp is provided inside a hollow roll, or a Ni-Cr alloy resistance heating wire is provided on the circumferential wall of the roll. Recently, however, a variety of rolls having a distributed heating resistor layer around a cylindrical substrate have been proposed. Although a resistor layer including alumina and an Ni-Cr alloy is generally used as the distributed resistor layer, the specific resistance of the nickel-chrome alloy is so low that it is necessary to make the layer thin. It has proved to be difficult to fabricate a thin resistor layer have a uniform and predetermined resistance value.

In order to eliminate or reduce this disadvantage, there has been proposed a resistor layer including one or more kinds of oxides selected from alumina, magnesia and alumina-magnesia spinel, and a nickel-chrome alloy (Japanese Patent Unexamined Publication No. 61-134776). There also has been proposed a resistor layer which has a predetermined resistance value and which is easily produced to a proper thickness.

Such a proposed heating resistor layer includes ceramic maerials such as alumina, etc. at a considerably high ratio so as to provide a predetermined resistance value. However, the resulting heating roll is weak against bending, and therefore cracks can form in the heating resistor layer with the result that the predetermined resistance value cannot be maintained, particularly if repeated slight flexures occur during the toner-fixing operation. Moreover, in the case where a heating resistor layer is formed on the circumference of a cylindrical substrate, a mixture of ceramic materials and an Ni-Cr alloy usually is applied to the circumference by thermal spraying to thereby form the resistor layer. In this process, however, the amount of conventional metal alloy components of the resistor layer do not generate enough heat by oxidation to bond adequately to the cylindrical substrate, making it difficult to provide a heating resistor layer with a predetermined, controlled thickness.

OBJECTS AND SUMMARY OF THE INVENTION

It is therefore an object of the present invention to make a heating roll heating resistor layer having a predetermined resistance value. A further object is to make a heating resistor layer having a high flexural strength by increasing the content of metal components while maintaining a large resistance value. It is a still further object to make heating resistor layer that can be strongly attached to a cylindrical substrate when the heating resistor layer is formed on the cylindrical substrate by thermal spraying.

The present invention relates to a heating roll provided with a heating resistor layer formed on a circumference of a cylindrical substrate, in which the heating resistor layer is improved over the prior art. The heating resistor layer of the present invention comprises an Fe-Cr-Al alloy phase dispersed in a ceramic substrate phase with the Fe-Cr-Al alloy phase being electrically continuous in the axial direction of the heating roll.

BRIEF DESCRIPTION OF THE DRAWING

The Figure is a schematic sectional view of a heating roll with a heating resistor layer made in accordance with the present invention.

DESCRIPTION OF THE PREFERRED EMBODIMENT

The present invention will be further described in detail with reference to the Figure. As depicted, bonding layer 2, inner insulating layer 3, heating resistor layer 4, outer insulating layer 5, and protecting layer 6 are formed on the circumference of a cylindrical portion of heating roll 1. The insulating layer 5 and the protecting layer 6 are not extended to cover the opposing end portions of roll 1, and annular electrodes 7 are provided on a circumference of the heating resistor layer 4 at its opposing end portions. The electrodes 7 are connected to a power source through discharging brushes shown schematically 8 so that the heating resistor layer 4 can generate heat when it is supplied with electric power through the electrodes 7. If the material of the cylindrical roll 1 is non-conductive, relatively adiabatic and easily coated with the heating resistor layer 4 (such as rolls formed from various ceramic materials and various heat-resisting resins), inner insulating layer 3 and bonding layer 2 may be unnecessary.

In a copying machine or the like, the above-mentioned heating roll 1 is rotatably supporting by bearings at its opposing end portions, and a pressure roller (for example, a roll provided with a heat-resisting elastomer layer such as silicone gum or the like formed on its surface) is pressed against the heating roll. Paper carrying a toner image is passed between the heating roll and the pressing roll so that the toner image is fixed onto the paper.

Preferably, the heating resistor layer 4 contains 10–30 wt. % of a Fe-Cr-Al alloy with the balance substantially consisting of a ceramic material. Heating resistor layer 4 can be formed by thermal spraying onto the cylindrical rollsubstrate 1. When the heating resistor layer 4 is formed by thermal spraying, the Fe-Cr-Al alloy phase becomes a layer extending longitudinally (axially) in the ceramic material phase so as to be electrically continuous resulting in the heating resistor layer 4 having a predetermined resistance value. In the case where the content of the Fe-Cr-Al alloy is below 10 wt. %, even if the Fe-Cr-Al alloy and a ceramic material are sprayed by arc-plasma, the content of the Fe-Cr-Al alloy in the ceramic material is so small that it is difficult to make the Fe-Cr-Al alloy disperse as a electrically continuous layer in the longitudinal direction. With the Fe-Cr-Al alloy axially discontinuous, the electrical path becomes tortuous so that the resistance of the heating resistor layer becomes extremely large.

Moreover cracks can be caused in the discontinuous portions by repeated impact of heat. Because the heating resistor layer is relatively weak against flexure when the amount of metal components is small, the electrical inter-connections within the Fe-Cr-Al alloy phase are apt to be broken when the heating roll is pressed and bent even slightly by the pressing roll. Further, sine the Al content in the Fe-Cr-Al alloy is small, sufficient heat generation due to oxidation cannot be obtained during thermal spaying for an alloy content below about 10 wt. % so that the alloy does not adhere strongly to the substrate roll.

In the case where the content of the Fe-Cr-Al alloy is larger than 30 wt. %, on the other hand, the specific resistance of the heating resistor layer becomes less than about $10^{-3}$ Ω/cm so that the layer cannot be used effectively as a heater.

It is also preferable that the Fe-Cr-Al alloy be composed of 64–89 wt. % of Fe, 10–30 wt. % of Cr and 2–10 wt. % of Al. The content of Al is selected to fall within a range of 2–10 wt. % because if the Al content is smaller than 2 wt. % the amount of heat generation due to oxidation during thermal spraying is so small that the Fe-Cr-Al alloy cannot be fuse-deposited with a sufficient degree of adhesion, while if the Al content is larger than 10 wt. % the deposited alloy phase becomes brittle. The content of Cr is selected to fall within the range of 10–30 wt. % because if the content of Cr is smaller than 10 wt. %, the electrical resistivity of the alloy is so lowered to the point where the alloy is unsuitable as a resistive heater material, while if the content is larger than 30 wt. % the metal alloy phase portion of the heater layer becomes brittle and is apt to fracture and be discontinuous.

As the ceramic phase of the heating resistor layer 4, $Al_2O_3$, $MgAl_2O_4$ and $ZrO_2$-$SiO_2$ may be used. Of these materials, $Al_2O_3$ is preferable because $Al_2O_3$ characteristically allows the Fe-Cr-Al alloy to disperse in the form of a layer continuous in the longitudinal direction.

A high strength aluminum alloy is often used in a conventional hollow heating roll using a halogen lamp based on considerations of ease of manufacture, heating uniformity, fast heatup, and so on. According to the present invention, however, it is preferable to use a material for a cylindrical roll-substrate 1, which has a coefficient of heating expansion near that of the ceramic material of the heating resistor layer 4, and therefore iron or an iron alloy is preferred.

For the bonding layer 2, Ni-Cr-Mo, Ni-Cr or a like alloy is used. When this material is applied by thermal spraying to the circumferential surface of the cylindrical roll substrate 1, this material generates heat by partial oxidation to produce oxides which increase the bonding strength between the cylindrical substrate 1 and the ceramic material phase of the heating resistor layer 4.

Inner insulating layer 3 electrically insulates the heating resistor layer 4 from the cylindrical substrate 1 and prevents the heat of the heating resistor layer 4 from being conducted to the cylindrical substrate 1. Therefore, $Al_2O_3$ or the like is used as the material of insulating layer 3, and a thickness of 200–500 μm is suitable for inner insulating layer 3.

Outer insulating layer 5 is necessary for electrically insulating the surface of the heating roll. Outer insulating layer 5 is preferably made of the same material as inner insulating layer 3, and a thickness of 30–200 μm is suitable for outer insulating layer 5.

Protecting layer 6 is provided to improve the offset-resisting property of the fixing apparatus and can be made of a fluorinated resin or a copolymer, a fluorine polymer, or the like such as polytetrafluoroethylene (PTFE), fluoroethlene-propylene (FEP), perfluoroalkoxy/tetrafluroethylene (PFA) or the like, protecting layer 6 being formed to a thickness of about 10–50 μm.

EXAMPLE 1

A bonding layer 2 of an Ni-Al-Mo alloy was formed to a 20 μm thickness by thermal spraying on an outer circumference of a cylindrical roll-substrate 1 having a length of 400 mm and an outside diameter of 35 mm. An insulating layer 3 of $MgAl_2O_4$ was further formed to a 300 μm thickness on bonding layer 2, and a heating resistor layer 4 containing 20 wt. % of Fe-Cr-Al alloy (65 wt. % Fe, 30 wt. % Cr and 5 wt. % Al) and 80 wt. % of $Al_2O_3$ was formed to a 100 μm thickness on insulating layer 3 by plasma spraying. Electrodes 7 were provided respectively at the axially opposed end portions of heating resistor layer 4, and then an insulating layer 5 of $MgAl_2O_3$ and a protecting layer 6 of PFA were successively provided on heating resistor layer 4 except at the location of electrodes 7 at the opposite end portions, to thereby complete a heating roll.

The thermal spraying was carried out by using the 7MB system of METCO Inc.. The completed roll was flexed 0.1 mm a total of 1000 times by applying a load to the central portion of the heating roll. The resistance value across the electrodes was measured before and after flexing to determine how the resistance value was influenced by the flexure. Table 1 shows the results of the measurements. Further, for the sake of comparison, two heating rolls were built in the same manner as described above but using an Ni-20 wt. % Cr alloy and an Ni-16 wt. %, Cr-24 wt. % Fe alloy, respectively, instead of the Fe-Cr-Al alloy which was the metal component of the heating resistor layer in the above-mentioned example, and the resistance values before and after flexing were measured. The results of these measurements are also shown in the Table 1 .

TABLE 1

| Alloy components | Before loading | After loading |
|---|---|---|
| Fe—Cr—Al | 12.6 ohms | 12.6 ohms |
| Ni—Cr | 12.3 ohms | 13.1 ohms |
| Ni—Cr—Fe | 12.5 ohms | 13.3 ohms |

As is apparent from Table 1, the heating roll according to the present invention using an Fe-Cr-Al alloy as the alloy of the heating resistor layer has the smallest change in the resistance value, demonstrating that the longitudinal electrical continuity of the alloy phase in the heating resistor layer is not interrupted by flexure. That is, although the heating roll is pressed by a pressing roll so as to be more or less bent when the heat roll is mounted in a heating and fixing apparatus and is made to perform repeated toner fixing operations, the performance of a heat roll made in accordance with the present invention will not deteriorate appreciably.

Moreover, the heating rolls of the above-mentioned examples, including both the roll made in accordance with the present invention and the rolls of comparative examples, were heated and cooled repeatedly 2600 times, and the respective resistance values across the electrodes were measured before and after the heating and cooling operations. The results of the measurements are shown in Table 2 .

TABLE 2

| Alloy components | Before loading heating/cooling | After loading heating/cooling |
|---|---|---|
| Fe—Cr—Al | 13.2 ohms | 13.2 ohms |
| Ni—Cr | 13.4 ohms | 13.7 ohms |
| Ni—Cr—Fe | 13.1 ohms | 13.4 ohms |

As is apparent from the Table 2 , the heating roll according to the present invention using the Fe-Cr-Al alloy has the smallest increase in resistance value and demonstrates that the heating layer is strongly attached to the cylindrical substrate and is resistant to heat cycling impact.

Further, the respective temperature coefficients of the above-mentioned heating resistor layer using the Fe-Cr-Al alloy according to the present invention, and the two comparative heating resistor layers using the Ni-Cr alloy and the Ni-Cr-Fe alloy, respectively, were measured. It was determined that the heating resistor layer using the Fe-Cr-Al alloy is the most stable against changes in pressure as well as against changes in temperature and is therefore highly desirable.

EXAMPLE 2

Heating rolls were produced with the heating resistor layer of Example 1 in which the proportions of the elemental components of the Fe-Cr-Al alloy were varied. The resistance values before and after application of a load to the center in the same manner as were the measurements reported in Table 1. The results of the measurement are shown in Table 3.

TABLE 3

| Alloy components % | | | | Resistance value (ohms) | |
|---|---|---|---|---|---|
| Fe | Cr | Al | others | Before Load | After Load |
| 78 | 19 | 3 | | 15.1 | 15.1 |
| 72 | 23 | 5 | | 14.7 | 14.7 |
| 64 | 28 | 8 | | 23.3 | 23.3 |
| 72.2 | 20 | 5 | 2.8* | 16.1 | 16.1 |
| 85 | 15 | 1 | | 12.3 | 13.7 |
| 90 | 5 | 5 | | 10.6 | 12.4 |

*Col.5%-MnO.8%-TiO.5%

Estimating from Table 3, it is preferable that the alloy phase is composed of 64–89 wt. % Fe, 10–30 wt. % Cr and 2–10 wt. % Al.

EXAMPLE 3

Heating rolls were produced with the heating resistor layer of Example 1 in which the ceramic phase components were varied and the resistance values before and after application of a load to the center determined in the same manner as in Table 1. The results of these measurements is shown in Table 4.

TABLE 4

| Ceramic components | Before loading | After loading |
|---|---|---|
| $Al_2O_3$ | 16.6 ohms | 16.6 ohms |
| $MgAl_2O_4$ | 17.1 ohms | 17.1 ohms |
| $ZrO_2$—$SiO_2$ | 16.9 ohms | 16.9 ohms |

As is apparent from Table 4, the resistance value did not change appreciably in any of the respective cases using the various ceramic components, but $Al_2O_3$ is preferable in view of its low-price and compatability with Fe-Cr-Al.

In summary, in the heating roll according to the present invention, the heating resistor layer is formed of an Fe-Cr-Al alloy phase and a ceramic material phase by thermal spraying so that an electrically continuous layer of the alloy phase is produced in the heating roll longitudinal direction. Further, the 10–30 wt. % metal alloy phase content in the heating layer is sufficient so that the heating roll is strengthened against flexure and the electrically continuous metal alloy phase does not crack readily. Moreover, the Fe-Cr-Al alloy generates sufficient heat by oxidation during thermal spraying of the heating resistor layer so that the deposited alloy strongly adheres to the substrate with the result that the electrically continuous layer is stable even if subjected to the impact of numerous heating and cooling cycles.

What is claimed is:

1. In a heating roll for fixing toner of the type in which a heating resistor layer is provided on the circumference of a cylindrical substrate so that when a voltage is applied to the heating resistor layer through an electrode, the heating resistor layer generates heat, wherein the improvement comprises the heating resistor layer being constituted by an Fe-Cr-Al alloy phase dispsersed into a ceramic substrate phase, said Fe-Cr-Al alloy phase being electrically continuous in the axial direction of said heating roll said Fe-Cr-Al alloy comprising 64–89 wt % of Fe, 10–30 wt. % of Cr, and 2–10 wt. % of al.

2. The improved heating roll for fixing toner according to claim 1, characterized in that said heating resistor layer comprises 70–90% of ceramic material and 10–30 wt. % of Fe-Cr-Al alloy.

3. The improved heating roll for fixing toner according to claim 1, characterized in that the ceramic material in said heating resistor layer is $Al_2O_3$.

* * * * *